United States Patent [19]

Yoshimura et al.

[11] 4,336,129

[45] Jun. 22, 1982

[54] METHOD FOR TREATING A WATER-CONTAINING WASTE OIL

[75] Inventors: Tokuo Yoshimura, Kitakyushu; Hiroshi Okazaki, Fukuoka; Mahito Soeda, Onga; Takeharu Yushima, Kitakyushu, all of Japan

[73] Assignees: Nippon Steel Chemical Co., Ltd., Tokyo; Shinnikka Environmental Engineering Co., Ltd., Fukuoka, both of Japan

[21] Appl. No.: 217,324

[22] PCT Filed: May 1, 1979

[86] PCT No.: PCT/JP79/00107

§ 371 Date: Mar. 4, 1980

§ 102(e) Date: Mar. 4, 1980

[87] PCT Pub. No.: WO80/02432

PCT Pub. Date: Nov. 13, 1980

[51] Int. Cl.[3] ..... C10M 11/00; C10G 33/04

[52] U.S. Cl. ..... 208/180; 208/181; 208/188

[58] Field of Search ..... 208/180, 188

[56] References Cited

U.S. PATENT DOCUMENTS

| | | | |
|---|---|---|---|
| 2,462,593 | 2/1949 | Batchelder | 208/188 |
| 2,609,931 | 9/1952 | Rodman et al. | 208/180 |
| 3,084,118 | 4/1963 | Overholt et al. | 208/188 |
| 3,282,827 | 11/1966 | Grysiak | 208/180 |
| 3,507,782 | 4/1970 | Strausser et al. | 208/188 |
| 3,607,721 | 9/1971 | Nagy | 208/188 |
| 3,900,389 | 8/1975 | Baillie | 208/188 |
| 3,985,642 | 10/1976 | Friel et al. | 208/180 |

FOREIGN PATENT DOCUMENTS

| | | | |
|---|---|---|---|
| 902600 | 8/1962 | United Kingdom | 208/188 |

*Primary Examiner*—Delbert E. Gantz
*Assistant Examiner*—Olik Chaudhuri
*Attorney, Agent, or Firm*—Gordon W. Hueschen

[57] ABSTRACT

A method for treating a water-containing waste oil comprising oils, water and solid constituents and forming a water-in-oil emulsion, which comprises adding to the water-containing waste oil having an aromatic oil ratio A as represented by the following formula:

$$\text{Aromatic oil ratio} = \frac{\text{Weight of aromatic oil content}}{\text{Weight of total oil content}}$$

at least 1% by weight, on the basis of the weight of the water-containing waste oil, of a treating oil having an aromatic oil ratio $B(|A-B|>0.5$ and excluding $0.4 \leqq B \leqq 0.6)$ thereby to separate the oil content.

21 Claims, 2 Drawing Figures

METHOD FOR TREATING A WATER-CONTAINING WASTE OIL

TECHNICAL FIELD

This invention relates to a method for treating a water-containing waste oil, and more particularly to a method for treating a water-containing waste oil comprising oil, water and sludge contents and forming a water-in-oil emulsion, by admixing therewith a certain specific solvent.

BACKGROUND ART

At a coal tar plant, coal tar distillation gives distillates such as carbolic oil, naphthalene oil, wash oil and anthracene oil. When subjected to phenols(or acid)-extraction or base-extraction treatment or when used for recovery of light oil from coke over gas, such distillates are in contact with water and thereby yield a water-containing waste oil. Further, coal tar contains water in itself, and therefore, a waste oil likewise forms during its storage in a tank or at the time of its distillation. Furthermore, similar waste oils result from the washing of the tanks for various distillate oils.

Oil originated from coal tar have greater hydrophilic property than oils originated from petroleum, and accordingly they tend to form a water-in-oil emulsion. Depending on their origins, water-containing waste oils differ more or less from each other in their characteristics. However, they normally contain not only oil and water but also solid substance, i.e. sludge, and they form an extremely stable emulsion comprising these three components.

Water-containing waste oils collected from coal tar plants have a relatively uniform composition and they normally contain 10 to 40% by weight of oil, 1 to 5% by weight of sludge and the rest being water. The sludge contains inorganic substances mainly comprising iron compounds, resinous matters comprising aromatic condensed ring compounds, coke powder, coal powder, etc., and is swelled in a water-containing waste oil about ten times of the volume of its dried state. The oil fraction contains mainly benzene homologues as light distillates, naphthalenes as medium distillates and tricyclic aromatic compounds such as anthracenes as heavy distillates. The specific gravity of the oil fraction is relatively close to that of water and it varies depending upon the composition of the particular oil. The specific gravity becomes smaller than water as the proportion of light distillates increases or as the temperature rises.

Further, various petroleum-based water-containing waste oils are known such as rolling oil wastes, lubricating oil wastes, or wash oil wastes which result from the rolling or tube making operations at ironworks, or from the washing of a coke oven gas with a petroleum-type absorption oil, or from machine tool works; crude oil wastes, heavy oil wastes, residual oils from tanks, sludge oils resulting from washing of crude oil tanks or heavy oil tanks, or the production line of lubricating oils at petroleum refineries and petrochemical factories; lubricating oil wastes, automobile engine oil wastes, cutting oil wastes, anti-corrosive oil wastes from automobile industries, machine making factories and ship yards. Depending upon their origins, these petroleum-based water-containing waste oils differ more or less in their characteristics. However, they normally contain not only oil and water but also sludge as solid constituent, and they also contain additives such as emulsifiers.

Thus, they form an extremely stable emulsion. For instance, waste oils derived from the rolling operation at a metal working plant, or from the washing operation of coke oven gas or from the machine tool works, are in a form of a water-in-oil emulsion (hereinafter referred to as W/O emulsion) comprising mixed oil which contains as principal constituent a petroleum-based oil such as a rolling oil, lubricating oil, machine oil or wash oil, water and fine solid particles such as iron oxides or carbon particles. Likewise, waste oils or sludge oils derived from the washing operation of the crude oil or heavy oil tanks at a petroleum refinery, or waste oils derived from the machine making factories or the like, are water-containing waste oils in a form of W/O emulsion.

These water-containing waste oils normally comprise at least 50% by weight of petroleum-based oil, 0.1 to 1.0% by weight of solid constituent (dry basis) and the rest being water. By a petroleum-based oil is meant an oil containing non-aromatic oil components as its principal constituents. The solid constituent comprises metal powders such as iron powder, iron compounds such as iron oxides, carbon particles, dusts or sands. In combination with water or oil, the solid content forms a sludge.

It is extremely difficult to treat such tar-based or petroleum-based water-containing waste oils for separation even by subjecting them directly to a centrifugal separator, as they are stable and undergo no substantial change with time in their original proportion of oil, emulsion, water and solid fractions. Further, the water-containing waste oils have poor combustibility and therefore they are inferior as fuels and they tend to block up the burner tip with sludge components.

It is known to add a certain surface active agent in order to recover oil components from tar-based water-containing waste oils (Japanese Unexamined Patent Publication No. 96,785/1976). However, this method is intended primarily to treat oil components heavier than water. Accordingly, when subjected to the centrifugal operation, while water can be separated satisfactorily, the separation of the sludge and oil can not be accomplished to a satisfactory degree. No satisfactory results are obtainable in such case where recovery of high quality oil is desired and where waste oils containing oil components lighter than water are treated.

There have been proposed various methods for treating petroleum-based emulsion type water-containing waste oils such as those mentioned above, for instance, a method wherein the waste oils are heated under pressure, and then cooled to separate the three phase of oil, water and solid, and each phase is centrifugally separated (Japanese Patent Publication No. 47,722/1976), a method wherein a waste oil is heated to demulsify the emulsion and after cooling, each layer is separated (Japanese Patent Publication No. 43,305/1976) or a method wherein a waste oil is centrifuged while being heated, whereby the sludge is separated from the oil and water, and the oil and water thus obtained are further centrifuged for separation (Japanese Unexamined Patent Publication 123,403/1977). These methods require great amounts of energy for heating, pressurizing and centrifuging and yet the separation of the oil and sludge is inadequate. Further, there has also been proposed a method wherein a light oil fraction is added to a sludge oil to extract the oil component and the extracted sludge oil thus obtained is heat treated or treated with a coagulant and then centrifugally separated into water and solid components (Japanese Patent Publication 15,025/1972), a method wherein a hydrocarbon solvent containing as its principal constituents propane, butane or a hydrocarbon mixture containing from propane to a light oil, is added to a waste oil or sludge thereby separating it into oil and sludge components (U.S. Pat. No. 3,684,699 and Japanese Unexamined Patent Publication No. 39,601/1974). However, these methods have drawbacks such that the operation is rather complicated or the separation of the oil and sludge components is inadequate. Further, it is known to add a coal tar neutral oil containing a small amount of a surface active agent dissolved therein to a sludge so as to disperse the sludge (U.S. Pat. No. 2,559,574). However, this method is not intended to separate the oil and water.

Accordingly an object of the present invention is to provide a novel method for treating a water-containing waste oil comprising oil, water and sludge and which is in a form of a water-in-oil emulsion.

Another object of the invention is to provide a method wherein a certain treating oil is added to a water-containing waste oil originated from coal tar or petroleum thereby to recover the oil components from the waste oil.

DISCLOSURE OF INVENTION

These objects may be accomplished by a method for treating a water-containing waste oil comprising oils, water and solid constituents and forming a water-in-oil emulsion, which comprises adding to the water-containing waste oil having an aromatic oil ratio A as defined by the following formula:

$$\text{Aromatic oil ratio} = \frac{\text{Weight of aromatic oil content}}{\text{Weight of total oil content}}$$

at least 1% by weight, on the basis of the weight of the water-containing waste oil, of a treating oil having an aromatic oil ratio B ($|A-B|>0.5$ and excluding $0.4 \leqq B \leqq 0.6$) thereby separating the oil content.

BEST MODE OF CARRYING OUT THE INVENTION

Figure 1:
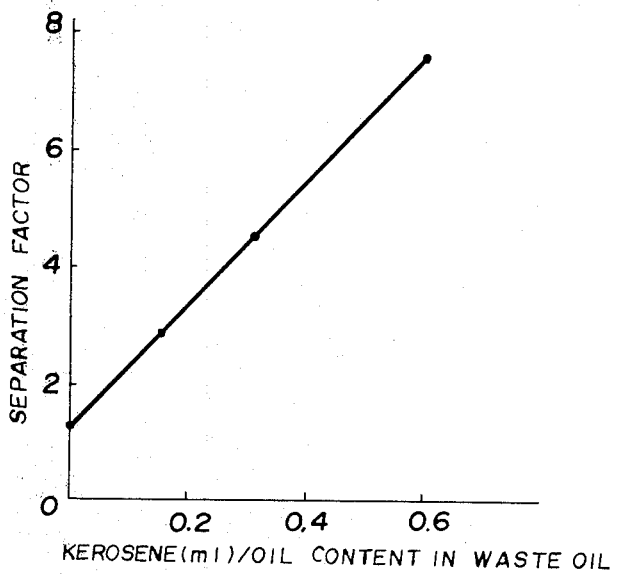
FIG. 1 is a graph showing an influence, over the separation factor, of the amount of kerosene added against the amount of the oil content in the coal tar-based water-containing waste oil.

The present inventors have found that it is possible to demulsify the above mentioned stable W/O emulsion and thereby to facilitate the precipitation of the sludge and its separation from water, by adding to a water-containing waste oil having an aromatic oil ratio A, i.e. a ratio of the weight of the aromatic oil content against the weight of the total oil content in the water-containing waste oil (hereinafter the aromatic oil ratio in the water-containing waste oil is simply called A) (preferably excluding the case where $0.4 \leqq A \leqq 0.6$), at least 1% by weight, preferably 2 to 100% by weight and more preferably 5 to 50% by weight, on the basis of the weight of the water-containing waste oil, of a treating oil having an aromatic oil ratio B, i.e. a ratio of the weight of the aromatic oil content against the weight of the total oil content in the treating oil (hereinafter the aromatic oil ratio in the treating oil is simply called B) ($|A-B|>0.5$ and excluding a case where $0.4 \leqq B \leqq 0.6$; preferably $|A-B|>0.7$ and excluding a case where $0.3 \leqq B \leqq 0.7$). It is possible to separate the oil components simply by allowing the treated oil to stand still. Further it is possible to facilitate the separation of the sludge by means of a centrifugal separation. A mixture of oil and water thus obtained after separation of the sludge is allowed to stand still whereby the interface of the two phases becomes distinctive thus showing an improvement in the separation of oil and water.

The aromatic oils are oils comprising aromatic compounds such as benzenes, naphthalenes, biphenyls and anthracenes. As an example of the oil having a high aromatic oil content, a tar-based oil is mentioned, whereas as an example of the oil having a low aromatic oil content there is a petroleum-based oil which is normally available.

As typical aromatic oils, there may be mentioned, benzene, toluene, xylene, trimethylbenzene, tetramethylbenzene, ethylbenzene, styrene, cumene, naphthalene, methylnaphthalene, dimethylnaphthalene, biphenyl, anthracene, phenanthrene, indene, diphenylmethane, dibenzofuran, fluorene and the like. Where an aromatic ring is substituted by an alkyl or alkenyl group having a high number of carbon atoms such an aromatic compound tends to lose characteristics of the aromatic oil and to gain characteristics of the non-aromatic oil. Accordingly an aromatic compound having non-aromatic substituents such as an alkyl or alkenyl group having more than six carbon atoms should preferably be excluded from the calculation for the aromatic oil content.

Further, for the convenience for calculation of the aromatic oil content it is recommended to employ as a parameter the aromatic index obtained by the following calculation. For further details of this calculation, a reference may be made to Brennstoff Chemie 42,378 (1961).

$$\text{Aromatic index} = C\,ar/C = 1-(\tfrac{1}{2})\times(H/C)\times(H_{al}/H)$$

in this formula, $C_{ar}/C$ is an atomic ratio of carbon atoms constitutional aromatic rings to the total carbon atoms, H/C is an aromatic ratio of hydrogen to carbon as obtained from an elementary analysis, and $H_{al}/H$ is an atomic ratio of non-aromatic hydrogen atoms to all hydrogen atoms which is obtained from the following formula $$H_{al}/H = \left(\frac{1}{1+2\times D_{ar}/D_{al}}\right)$$

(where, $D_{ar}/D_{al}$ is an absorbance ratio of stretching vibration spectrum of C-H bonds, and is obtainable by absorbance of aromatic bond (3.3μ)/absorbance of aliphatic bond (3.42μ).

The aromatic factor thus obtained is useful as a reference for calculation of aromatic oil content. In particular, except in a case where peculiar oils such as a long chain alkybenzene or polyalkybenzene are involved, the aromatic factor can practically be used as the aromatic oil content in most cases.

Upon comparison of various kinds of treating oils to be added, it has been found that aromatic oils ranging from light oils such as benzene, toluene, and xylene to oils having high boiling points such as methylnaphthalene oil do not give adequate separation performance for coal tar-based water containing waste oils ($A>0.5$, preferably $A>0.6$). Whereas, oils derived from petroleum and containing 60% by weight or more, preferably 70% by weight or more of aliphatic hydrocarbons, which range from light oils such as hexane to oils having high boiling points such as fuel oil-C (according to Japanese Industrial Standard (hereinafter referred to JIS No. K2205), exhibit excellent separation performance. For instance, oils such as leadless gasoline containing 40% by weight or more of aromatic hydrocarbons are not suitable, whereas oils remaining after extraction of aromatic hydrocarbons from a cracked gasoline are useful. The treating oils must be liquid at room temperature.

The treating oils may differ in their separation performance more or less depending on their individual natures but provide sufficient performance for practical purposes. For use in practice, they may be selected taking into account such factors as manageability for handling, availability, and costs. From practical point of view, kerosene, light oil and fuel oil-A (according to JIS K 2205) as originated from petroleum are most suitable. Further, petroleum-based water-containing waste oil is likewise useful and economical and it is extremely advantageous to use this waste oil for treatment of other water-containing waste oil simply by admixing the waste oils. The amount of the treating oil to be used is determined taking into accouts the amounts of oil and sludge contents in the water-containing waste oil to be treated, and conditions for treatment and apparatus to be used for treatment. In general, however, if the difference between A of the water-containing waste oil and B of the treating oil is 0.8 or more, the amount of the treating oil per the amount of the water-containing oil (a ratio by weight) is at least 1% by weight, preferably 2 to 100% by weight and more preferably 5 to 50% by weight. Generally, when an additive such as a surface active agent is added, the amount to be used may be small, whereas when the difference between A and B is small, it is necessary to use a greater amount. Where the specific gravity of the oil content in the water-containing waste oil is greater than the specific gravity of water, the specific gravity of oil phase becomes greater than that of water, and it is necessary to add a solvent having a low specific gravity for adjustment. As far as the separation performance is concerned, there is no upper limit for the amount to be added, but it is not economical to use a greater amount.

On the other hand, various kinds of the treating oils have been compared for the treatment of petroleum-based water-containing waste oils ($A<0.5$, preferably $A<0.4$), and it has been found that aliphatic hydrocarbon oils ranging naphtha, kerosene, light oil and heavy oil, do not provide satisfactory separation performance with such petroleum-based water-containing waste oils.

Whereas, it has been found that aromatic oils containing at least 60% by weight, preferably 70% by weight or more, of aromatic hydrocarbons are useful as the treating oils for the petroleum-based water-containing waste oils. For example, there may be mentioned a light oil obtained by the absorption treatment of coke oven gas by an absorption oil, a light oil obtained by the fractional distillation of coal tar, a reformed oil obtained by aromatization of petroleum naphtha, crude or refined benzene, toluene or solvent naphtha obtained by the fractional distillation the reformed oil, or naphthalene oil, absorption oil, anthracene oil, creosote oil or a mixture thereof obtained from coal tar. Among these oils, aromatic oils mainly comprising distillates having a boiling point of 130° to 275° C. are particularly useful. Particularly, aromatic oils containing 20 to 60% of naphthalene is most useful. As an example of such aromatic oils, there may be mentioned a residual oil obtained by distillation of a tar light oil to remove the distillates up to xylene.

Further, a coal tar-based water-containing water-containing waste oil is also useful as the treating oil. For example, there may be mentioned waste oils obtained at coal tar plants by the phenols (or acid)-extraction or base extraction of coal tar distillates such as carbolic oil, naphthalene oil, wash oil or anthracene oil, and waste oils obtained by washing storage tanks for various oils.

The amount of the aromatic treating oils to be added is determined taking into account oil and sludge contents of the petroleum-based water-containing waste oil, the conditions for treatment, and the apparatus to be used for treatment. In general, however, if the difference between A of the water-containing waste oil and B of the treating oil is 0.8 or more, the amount of the treating oil per the amount of the water-containing waste oil (a ratio by weight) is at least 1% by weight, preferably 2 to 100% by weight or more preferably 5 to 50% by weight. Generally, when an additive such as a surfactant is added, the amount to be used may be smaller whereas when the difference between A and B is small, it is necessary to use a greater amount. As far as the separation performance is concerned, there is no upper limit for the amount to be added but it is not economical to use a greater amount.

The treatment of the water-containing waste oils by means of these treating oils is conducted at pH 4 to 8, preferably 6 to 7, whereby particularly good results are obtained.

Further, for the treatment of the coal tar-based water-containing waste oils, a favourable result is obtainable by using, in combination with the treating oil, a cationic surfactant containing a quaternary ammonium salt or an imidazole derivative as principal component. As such cationic surfactants, there may be mentioned an alkyl trimethylammonium salt, an alkyl hydroxyethyl imidazoline, an alkyl imidazoline acetate and an alkyl imidazoline salt. The cationic surfactants are added in an amount of 100 to 3,000 ppm, preferably 200 to 1,500 ppm, to the water-containing waste oils.

Further, for the treatment of the petroleum-based water-containing waste oils, anionic or non-ionic surfactants may advantageously be used together with the above mentioned treating oils whereby the amount of the treating oils to be added may considerably be reduced. As such anionic surfactants, there may be mentioned a fatty acid salt $R_1CH_2COOM$ (where $R_1$ is an alkyl or alkenyl group having 11 to 17 carbon atoms, and M is Na or K), triethanolamine sulfonate or sodium sulfonate $R_2SO_3Na$ (where $R_2$ is an alkyl group having 12 to 18 carbon atoms),

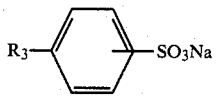

(where $R_3$ is an alkyl group having 11 to 15 carbon atoms),

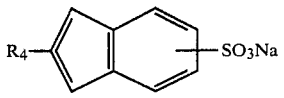

(where $R_4$ is an alkyl group having 1 to 4 carbon atoms), $R_5CHCOOH$ (where $R_5$ is an alkyl group having 11 to 17 carbon $SO_3Na$ atoms), $R_6COOH_2SO_3Na$ (where $R_6$ is an alkyl group having 11 to 17 carbon atoms), $$R_7\overset{\overset{\displaystyle CH_3}{|}}{C}ONHCH_2CH_2SO_3Na$$

(where $R_7$ is an alkyl group having 11 to 17 carbon atoms), $$\begin{array}{c} R_8OOCCHSO_3Na \\ | \\ R_8'OOCCH_3 \end{array}$$

(where $R_8$ and $R_8'$ are alkyl group having a total of 10 to 20 carbon atoms), a lignin sulfonate, a higher alcohol, sulfuric ester salt $R_9OSO_3Na$ (where $R_9$ is an alkyl group having 12 to 18 carbon atoms).

$$\begin{array}{l} R_{10}' \diagdown \\ \qquad CHSO_3Na \\ R_{10}' \diagup \end{array}$$

(where $R_{10}$ and $R_{10}'$ are alkyl groups having 12 to 18 carbon atoms), polyoxyethylene alkylether sulfate $R_{11}(CH_2CH_2O)_nSO_3Na$ (where $R_{11}$ is an alkyl group having 8 to 18 carbon atoms, and n is an integer of 1 to 20),

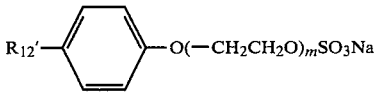

(where $R_{12}$ is an alkyl group having 8 to 18 carbon atoms, and m is an integer of 1 to 20), and an alkyl succinic ester. As nonionic surfactants, there may be mentioned a poly (oxyethylene)glycol alkylether $R_{13}—O(CH_2CH_2O)_nH$ (where $R_{13}$ is an alkyl group having 6 to 30 carbon atoms and n is an integer of 3 to 120), a poly(oxyethylene)alkyl arylether

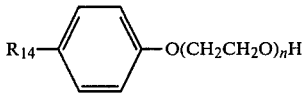

(where $R_{14}$ is an alkyl group having 6 to 12 carbon atoms and n is an integer of 3 to 120), a poly(oxyethylene)alkylester $R_{15}—COO(CH_2CH_2O)H$ or $R_{15}—COO(CH_2CH_2O)_{n-1}CH_2CH_2—COOR_{15}$ (where $R_{15}$ is an alkyl group having (6 to 24 carbon atoms, and n is an integer of 3 to 120), a poly(oxyethylene)alkylamine $R_{16}—NH(CH_2CH_2O)_nH$ or $$R_{16}—N\begin{array}{l} \diagup (CH_2CH_2O)_nH \\ \diagdown (CH_2CH_2O)_nH \end{array}$$

(where $R_{16}$ is an alkyl group having 6 to 30 carbon atoms, and n and n' are integers of 1 to 120), a poly(oxyethylene)alkylamide $R_{17}—CONH(CH_2CH_2O)_nH$ or $$R_{17}—CON\begin{array}{l} \diagup (CH_2CH_2O)_nH \\ \diagdown (CH_2CH_2O)_nH \end{array}$$

(where $R_{17}$ is an alkyl group having 6 to 30 carbon atoms, and n and n' are integers of 3 to 120), a poly(oxyethylene)sorbitan fatty acid ester

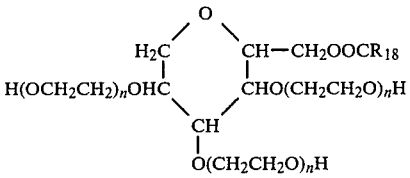

(where $R_{18}$ is an alkyl group having 6 to 24 carbon atoms, and n is an integer of 3 to 60), a pluronic type poly(oxyethylene)poly(oxypropylene) copolycondensation product $OH(CH_2CH_2O)_a(CH_3CHCH_2O)_b(CH_2CH_2O)_cH$ (where a, b and $c>1$ and $(a+b+c)=20$ to 400), and a Tetronic type copolycondensation product

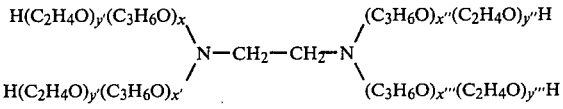

(where x to x''' and y to $y'''>1$, and $x+X'+X''+X'''+y+y'+y''+y'''=20$ to 800).

These surfactants may normally be added in an amount of 100 to 5,000 ppm, preferably 500 to 2,000 ppm based on the water-containing waste oil.

The above mentioned surfactants may be added as an aqueous solution of 1 to 10% if they are water soluble. If they are oil soluble, they may be added as they are or as dissolved in a petroleum-based or a coal tar-based treating oil.

After addition of an aliphatic or an aromatic treating oil and, if necessary, a surfactant, to the water-containing waste oil, it is necessary to agitate the mixture sufficiently to effect adequate admixing and contacting, and it is preferred to heat the mixture for this admixing operation. A suitable method of admixing may be employed such as pumping to circulate the mixture in a tank or mixing by means of line mixer. The heating should be conducted to give a temperature as high as possible within a limit that no problem is created the gasification of the waste oil or the solvent, practically 20° to 90° C. and preferably 50° to 70° C.

After the addition and admixing of the aliphatic or aromatic treating oil, the mixture is allowed to stand still whereby the oil components are separated. Further, after the addition and admixing of the aliphatic or aromatic treating oil, a sludge may be removed for instance by means of centrifugal separation, thereby facilitating the separation of the oil components. As a method for removing the sludge, the centrifugal method is most suitable. The greater the centrifugal force, the higher the separation efficiency becomes. However, the centrifugal force is normally at least 800 G and taking an economical aspect into consideration a preferred range is 2,000 to 4,000 G. It is preferred to carry out the separation of the sludge when applying this centrifugal force.

As apparatus for carrying out the sludge separation and oil-water separation simultaneously, various centrifugal separation apparatus may be used. Filtration apparatus are subject to a problem of blocking up of the filter if it is not surface replaceable type. With the surface replaceable type filter, it is then difficult to completely separate the sludge. For these reasons, the use of a centrifugal apparatus is preferred.

The filtration from which the sludge was removed by a centrifugal apparatus, is allowed to settle whereby it is separated into two phases, i.e. the upper oil layer and the lower water layer, with little emulsion layer left at the interface, and the oil layer and the water layer readily be separated and recovered, respectively.

The oil fraction thus recovered is at least useful as fuel. It may be used for more valuable purpose depending on the nature of the original waste oil from which it is recovered. On the other hand, the water layer contains only a dissolved amount of the oil and can readily be purified by activated sludge treatment without requiring any further pretreatment.

The method of the present invention will now be described in further detail with reference to the examples. The percentage used in the following examples is by weight unless otherwise specified.

EXAMPLES 1 TO 6 AND COMPARATIVE EXAMPLES 1 TO 3

A water-containing waste oil (a mixture of waste oils collected at a coal tar plant) containing 34.7% of an aromatic oil (A>0.9) which has a specific gravity and viscosity at 60° C. of 1.007 and 2.4 centipoise, respectively, and a H/C ratio (atomic ratio) of 1.015 and 2.3% of sludge (dry basis) and forming a water-in-oil emulsion, was used as the sample material.

A glass centrifuge tube graduated at 50 ml. was filled with 30 ml. of the sample material and 6 ml. of each treating oil, the mixture was agitated at 60° C. for 15 minutes and centrifuged at 1,500 G for 15 minutes with use of a centrifuge. The results as shown in Table 1 were obtained from the measurement of the oil layer, the water layer and the sludge layer which were separated in the centrifuge tube.

TABLE 1

| Nos. | Treating oils | Water recovery factor (X) | Oil recovery factor (Y) | Sludge layer Proportion (Z) | Separation factor |
|---|---|---|---|---|---|
| Examples | | | | | |
| 1 | n-hexane (B = 0) | 77 | 84 | 19 | 4.1 |
| 2 | n-octane (B = 0) | 90 | 82 | 11 | 7.8 |
| 3 | kerosene (B < 0.1) | 83 | 76 | 10 | 7.6 |
| 4 | light oil (B < 0.1) | 79 | 88 | 15 | 5.5 |
| 5 | fuel oil-A (B < 0.1) | 56 | 85 | 19 | 3.6 |
| 6 | fuel oil-C (B < 0.1) | 66 | 82 | 13 | 5.6 |
| Comparative | | | | | |

TABLE 1-continued

| Nos. | Treating oils | Water recovery factor (X) | Oil recovery factor (Y) | Sludge layer Proportion (Z) | Separation factor |
|---|---|---|---|---|---|
| Examples | | | | | |
| 1 | xylene (B = 1) | 58 | 86 | 29 | 2.5 |
| 2 | methylnaphthalene (B = 1) | 19 | 48 | 68 | 0.5 |
| 3 | leadless gasoline (B = 0.5) | 56 | 54 | 19 | 2.8 |

Notes:

$$\text{Water recovery factor (X)} = \frac{\text{Separated water (ml)}}{\text{Water (ml) in waste oil}} \times 100$$

$$\text{Oil recovery factor (Y)} = \frac{\text{Separated oil (ml)}}{\text{Oil (ml) in waste Oil + Treating Oil (ml)}} \times 100$$

$$\text{Sludge layer proportion (Z)} = \frac{\text{Separated sludge (ml)}}{\text{Waste oil (ml) + Treating oil (ml)}} \times 100$$

$$\text{Separation factor} = \frac{X + Y}{2Z}$$

The water recovery factor and the oil recovery rate closer to 100 indicate better separation performance. The smaller the sludge layer proportion is, the better the sludge is processed and the easier the centrifugal separation of the sludge becomes. These relationships are represented by a single equation of the separation factor which is found to fairly well correspond to the actual separation efficiency. The greater the separation factor is, the better the actual separation becomes.

It is apparent from Table 1 that when the difference between A and B is 0.5 or less, the separation efficiency is lower, particularly for the separation of the sludge, in the treating oil having a high aromatic compound content.

EXAMPLE 7

In a manner similar to Example 3, separation factors were obtained at various amounts of a kerosene used as the treating oil. The results, including Example 3 (0.6 ml. kerosene/ml. of oil in waste oil), are shown in FIG. 1.

EXAMPLE 8

2.6 $m^3$ of kerosene was added to 10 $m^3$ of the water-containing waste oil (A>0.9) originating from a tar plant and containing 26.7% of oil, 1.2% of sludge (dry basis) and the remainder of water, and the mixture was heated and agitated in a tank at 65° C. for 3 hours. This mixture was introduced to a centrifugal separator (Super Decanter) at a rate of 0.5 $m^3$/hr, and treated at 3,000 g for a residence time of 1.4 minutes, whereby the sludge and a liquid were continuously separated. The separated liquid fraction was allowed to stand still in a settling tank whereupon the oil fraction and the water fraction were recovered from the upper layer and the lower layer, respectively. The sludge thus obtained contained 27.1% of water and 47.8% of oil. The recovered oil fraction contained 0.3% of water and 0.06% of sludge. The separated water contained 66 ppm of oil and 22 ppm of suspended solids and was treated directly with the activated sludge treating apparatus.

EXAMPLES 9 TO 12

In a manner similar to Example 3, 30 ml. of the same sample material, 3 ml. of kerosene and 1,000 ppm of each of various surfactants were filled in a graduated glass centrifuge tube and the mixture was agitated at 60° C. for 30 minutes, and then centrifuged at 980 G for 15 minutes by means of a centrifuge. Water soluble surfactants were added as a 2% aqueous solution and oil soluble surfactants were added as a 2% kerosene solution. The results as shown in Table 2 were obtained from the measurements of the oil layer, the water layer and the sludge layer which were separated in the centrifuge tube.

TABLE 2

| Examples | Surfactant | Water Separation Factor (X) | Oil Separation Factor (Y) | Sludge Proportion (Z) | Separation Factor |
|---|---|---|---|---|---|
| 9 | Alkyl-trimethylammonium salt | 98.0 | 78.3 | 11.6 | 7.6 |
| 10 | Alkylhydroxyethyl imidazoline | 97.9 | 78.3 | 12.1 | 7.3 |
| 11 | Alkyl imidazoline acetate | 102.9 | 76.9 | 8.7 | 10.3 |
| 12 | Alkyl imidazoline salt | 103.2 | 77.2 | 8.1 | 11.1 |

Notes:

Water Separation Factor (X)

$$= \frac{\text{Separated Water (ml)}}{\text{Water (ml) in waste oil + Water (ml) in Surfactant (When added as an aqueous solution)}}$$

Oil Separation Ratio (Y)

$$= \frac{\text{Separated Oil (ml)}}{\text{Oil (ml) in waste oil + Added Kerosene (ml)}}$$

Sludge Proportion (Z)

$$= \frac{\text{Precipitated Sludge (ml)}}{\text{Waste oil (ml) + Added Kerosene and Surfactant (ml)}}$$

$$\text{Separation Factor} = \frac{X + Y}{2Z}$$

EXAMPLE 13

Figure 2:
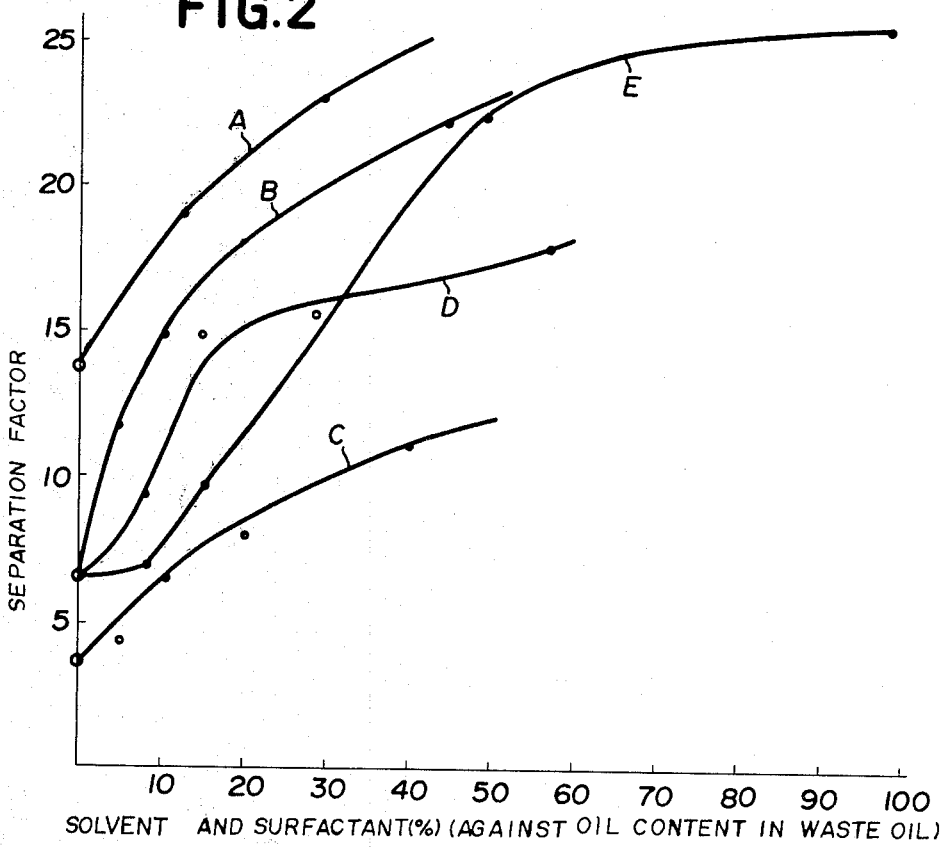
FIG. 2 is a graph showing an influence, over the separation factor, of the solvent and a surfactant added against the coal tar-based water-containing waste oil.

In a manner similar to Example 10, the relation between the separation factors and the amounts of the solvent and alkyl hydroxyethylimidazoline added was studied, with kerosene, fuel oil-A and fuel oil-C being used as the solvent. The centrifugal force was 1,250 G. The results are shown in FIG. 2. The curved lines in the FIG. represent the following:

| Lines | Solvent | Surfactant (ppm) |
|---|---|---|
| A | kerosene | 2,000 |
| B | kerosene | 1,000 |
| C | kerosene | 500 |
| D | fuel oil-A | 1,000 |
| E | Fuel oil-C | 1,000 |

EXAMPLES 14 AND 15 AND COMPARATIVE EXAMPLES 4 AND 5

A mixed waste oil from a metal working plant comprising petroleum oils such as rolling oils or machine oils as principal components and having a specific gravity at 4° C. of 0.842 and which contains 75% of oil (A<0.1) having elementary analysis values of C 85.3% and H 13.7%, 26% of water and 1.2% of solid components (dry basis) such as iron oxides and which is in a form of a water-in-oil emulsion, a treating oil and an additive were introduced into a centrifuge tube of 50 cc., and were then heated in a water bath at 60° C. for 30 minutes while being agitated from time to time. Then the mixture was subjected to a centrifuge separation at 1,250 G for 15 minutes by means of centrifuge. The centrifuge tube was withdrawn and the volumes of the oil layer, the intermediate layer (emulsion) between the oil layer and the water layer, the water layer and the precipitated layer (solid components plus water) were measured. The experimental results obtained for various kinds of the additives are shown in Table 3.

TABLE 3

| Nos. | Waste Oil (ml) | Treating oils Additives Kinds | Amount (ml) | Volumes (ml) after centrifugal separation: Oil layer | Intermediate layer | Water layer | Precipitated layer | Total | Oil separation factor (%) |
|---|---|---|---|---|---|---|---|---|---|
| Example 14 | 30 | Tar mixed oil I | 9 | 28 | 9.5 | 1 | 0.5 | 39 | 91 |
| Example 15 | 30 | Tar mixed oil I | 9 | 29.5 | 0.5 | 7 | 2 | 39 | 95 |
| | | Anionic surfactant | 0.03 | | | | | | |
| Comparative Example 4 | 40 | None | — | 1 | 30 | 7 | 2 | 40 | 3 |
| Comparative Example 5 | 30 | Kerosene | 9 | 1 | 30 | 6 | 2 | 39 | 3 |

Note 1.

Tar mixed oil I: a tar-based light oil distillation residue (B > 0.9) consisting mainly of xylene, trimethylbenzene, naphthalene, methylnaphthalene and having a boiling point of about 140 to 230° C.

Note 2.

Anionic surfactant: dioctyl sodium sulfosuccinate

Note 3.

$$\text{Oil separation factor (\%)} = \frac{\text{Volume of oil layer after centrifugal separation} \times 100}{\text{Treating oil + Oil content in waste oil}}$$

EXAMPLES 16 to 25 AND COMPARATIVE EXAMPLES 6 TO 7

A mixed waste oil (A−0.2) from an ironworks containing petroleum oils such as lubricant oils, and wash oils for coke oven gas, as principal components, and having a specific gravity at 4° C. of 0.835 and which contains 55% of oil having elementary analysis values of C 85.5% and H 13.2%, 44% of water and 1.5% of solid content (dry basis) such as carbon particles and which is in a form of an emulsion, was admixed with a treating oil and an additive. The mixture was subjected to the centrifuge experiments in a manner similar to Examples 14 and 15. The results thereby obtained are shown in Table 4.

TABLE 4

| Nos. | Waste oil (ml) | Treating oils, Additives: Kinds | Treating oils, Additives: Amounts (ml) | Volumes (ml) after centrifugal separation: Oil layer | Intermediate layer | Water layer | Precipitated layer | Total | Oil separation factor (%) |
|---|---|---|---|---|---|---|---|---|---|
| Example 16 | 30 | Grade 5 Xylene (B = 1) | 15 | 29 | 3.5 | 10.5 | 2 | 45 | 92 |
| Example 17 | 30 | Grade 5 Xylene Anionic surfactant | 15 2000 ppm | 32 | trace | 8 | 5 | 45 | 100 |
| Example 18 | 30 | Methyl-naphthalene (B = 1) | 6 | 21 | 3 | 10 | 2 | 36 | 98 |
| Example 19 | 30 | Methyl-naphthalene Anionic surfactant | 6 2000 ppm | 22 | trace | 9.5 | 4.5 | 36 | 100 |
| Example 20 | 30 | Coal tar absorption oil (B > 0.9) | 6 | 21.5 | 1.5 | 11 | 2 | 36 | 100 |
| Example 21 | 30 | Coal tar absorption oil Anionic surfactant | 6 | 22 | trace | 10 | 4 | 36 | 100 |
| Example 22 | 30 | Tar mixed Oil I | 6 | 21.5 | 1.5 | 10 | 3 | 36 | 100 |
| Example 23 | 30 | Tar mixed Oil I | 6 2000 ppm | 23 | trace | 8 | 5 | 36 | 100 |
| Example 24 | 30 | Aromatic solvent naphtha (B > 0.9) | 15 | 29 | 3 | 11 | 2 | 45 | 92 |
| Example 25 | 30 | Aromatic solvent naphtha Anionic surfactant | 15 2000 ppm | 31 | trace | 9 | 5 | 45 | 98 |
| Comparative Example 6 | 30 | Kerosene | 15 | 27 | 4.5 | 10 | 3.5 | 45 | 86 |
| Comparative Example 7 | 35 | None | — | 16 | 4 | 12 | 3 | 35 | 83 |

Note 1.
Coal tar absorption oil: Distillate fraction having a boiling point of 250° C. to 300° C. in the vicinity of dimethyl naphthalene to anthracene.
Note 2.
Anionic surfactant: dioctyl sodium sulfosuccinate.

EXAMPLE 26

To a waste oil from an ironworks having the same composition as the one in Example 16, 20% by volume of the tar mixed oil I of Example 14 and 2,000 ppm of dioctyl sodium sulfosuccinate were added, and the mixed liquid was agitated at 70° C. for 30 minutes. Then, the liquid was subjected to filtration under a reduced pressure of 250 to 300 mm Hg by means of 11 G 3 glass filter. After 150 minutes, the filtration was still possible. The filtrate obtained by 150 minutes was 73 ml. The filtrate was readily separated to an oil layer and a water layer.

COMPARATIVE EXAMPLE 8

The procedure of Example 26 was followed without addition of the tar mixed oil I. After about 60 minutes, the filtration became impossible due to blocking up of the filter. The filtrate obtained by this time was 20 ml.

EXAMPLE 27 AND COMPARATIVE EXAMPLE 9

To 20 ml of a crude oil tank sludge comprising 88.6% by volume of waxy material (A−0.1), 7% by volume of water, and 4.4% by volume of solid content (dry basis) and having a specific gravity of about 0.9, 20 ml of the tar mixed oil I of Example 14 or kerosene was added and heated at a temperature of 80° C., and the procedure of Example 14 was followed under the same conditions for heat mixing and centrifugal separation, whereby the results as shown in Table 5 were obtained.

TABLE 5

| Nos. | Treating oils | Volumes (ml) after centrifugal separation: Oil layer | Intermediate layer | Water layer | Precipitated layer | Total | Oil separation factor (%) |
|---|---|---|---|---|---|---|---|
| Example 27 | Tar mixed oil 1 | 33.5 | 0.5 | 2 | 4 | 40 | 89 |
| Comparative Example 9 | Kerosene | 24 | 12 | — | 4 | 40 | 64 |

Further, a similar experiment was carried out without using the treating oil, whereby no separation of the emulsion occurred.

EXAMPLES 28 TO 33

To a waste oil from an ironworks similar to the one used in Example 14, 30% of a residual oil (B−0.9) (boiling point of about 140° to 230° C.) which was obtained by distillation of tar-based light oil whereby distillates up to xylene were removed, and a surfactant were added and mixed. The mixture was heated at 70° C. for 30 minutes, and then subjected to the centrifugal separation at 1250 G for 15 minutes. The results are shown in Table 6.

TABLE 6

| Examples | Surfactants | Kind | Amount | Volumes (ml) after centrifugal separation: Oil layer | Intermediate layer | Water layer | Precipitation |
|---|---|---|---|---|---|---|---|
| 28 | Amionic | Triethanolamine dodecylbenzenesulfonate | 1000 ppm | 30.0 | 2.0 | 6.5 | 0.5 |
| 29 | | Dioctyl sodium sulfosuccinate | 1000 | 29.5 | 0.5 | 7.0 | 2.0 |
| 30 | | Succinic acid ester | 1000 | 25.5 | 5.5 | 7.5 | 0.5 |
| 31 | | Sodium dodecylbenzenesulfonate | 1000 | 23.5 | 7.0 | 7.0 | 1.5 |
| 32 | Nonionic | Ethyleneoxide-propyleneoxide copolymer | 1000 | 18.0 | 15 | 4.5 | 1.5 |
| 33 | | Sorbitan monopalmitate | 1000 | 15.0 | 18.5 | 4.0 | 1.5 |

EXAMPLE 34

0.02 part of a residual oil (boiling point of 140 to 230° C.) obtained by the distillation of tar light oil to remove the distillates up to xylene, and 2,000 ppm of triethanolamine sodium dodecylbenzenesulfonate, were added to 1 part of an automobile engine oil waste (composition measured by a centrifugal separation method: 91.7% by volume of oil (A<0.1), 3.8% by volume of water and 4.5% by weight of precipitation). The mixture was heated and agitated and then subjected to the centrifugal separation experiments.

As the results, 0.91 part of oil, 0.04 part of water and 0.007 part of the precipitation were recovered.

Further, when the mixture was heated at 80° C. for 2 hours and kept to stand still, slightly more than 0.7 volume of a clear oil layer appeared as the upper layer. When the mixture was further kept to stand still at a room temperature for 24 hours, the volume of the oil layer became slightly more than 0.8 volume.

When the waste oil alone was heated at 80° C. and kept to stand still, there appeared no change even after two hours.

EXAMPLES 35 TO 39 AND COMPARATIVE EXAMPLES 10 AND 11

A mixed waste oil from an ironworks containing petroleum oils such as rolling oils or machine oils as principal components and having a specific gravity at 4° C. of 0.842 and which contains 73% of oil (A<0.2) having elementary analysis values of C 85.3% and H 13.7% and which is in a form of a water-in-oil emulsion, and a tar-based water-containing waste oil were introduced in predetermined amounts into a centrifuge tube of 50 cc, and were then heated in a water bath at 60° C. for 30 minutes while being agitated from time to time. The mixture was subjected to a centrifugal separation at 1,250 G for 15 minutes by a centrifuge. The centrifuge tube was withdrawn and the volumes of the oil layer, the intermediate layer (emulsion) between the oil layer and the water layer, the water layer and the precipitated layer (solid content plus water) were measured. The experimental results are shown in Table 7.

TABLE 7

| Nos. | | Waste oil (ml) | Tar-based water containing waste oil, or additives | Amount (ml) | Volumes (ml) after centrifugal separation: Oil layer | Intermediate layer (emulsion) | Water layer | Precipitated layer | Oil separation factor (%) |
|---|---|---|---|---|---|---|---|---|---|
| Examples | 35 | 30 | Water-containing waste oil from a tar plant | 12 | 24 | 2 | 11.5 | 4.5 | 90 |
| | 36 | 30 | Water-containing waste oil from a tar plant Anionic surfactant | 12 | 24.5 | 1.5 | 12.0 | 4 | 92 |
| | 37 | 30 | Water-containing waste oil from a tar plant Nonionic surfactant | 12 | 25 | 1 | 12.0 | 4 | 94 |
| | 38 | 12 | Water-containing | 30 | 18 | 2 | 17 | 5 | 86 |

TABLE 7-continued

| Nos. | | Waste oil (ml) | Tar-based water containing waste oil, or additives | Amount (ml) | Volumes (ml) after centrifugal separation: Oil layer | Intermediate layer (emulsion) | Water layer | Precipitated layer | Oil separation factor (%) |
|---|---|---|---|---|---|---|---|---|---|
| | | | waste oil from a tar plant | | | | | | |
| | 39 | 12 | Water-containing waste oil from a tar plant Cationic surfactant | 30 | 20.5 | 1 | 15.5 | 5 | 98 |
| Comp. Examples | 10 | 40 | None | — | 1 | 30 | 7 | 2 | 3 |
| | 11 | 30 | Kerosene | 9 | 1 | 30 | 6 | 2 | 3 |

Note 1.
Water-containing waste oil from a tar plant: Water-containing waste oil having a specific gravity and viscosity at 60° C. of 1.007 and 2.4 c.p., respectively and containing 34.7% of oil having a H/C factor (atomic ratio) of 1.015 and 2.3% of solid content (dry basis) (Collected from a coal tar plant) (B > 0.8)
Note 2.
Anionic surfactant: Dioctyl sodium sulfosuccinate ester
Nonionic surfactant: Ethylene oxide-propylene oxide copolymer
Cationic surfactant: Alkylhydroxyethyl imidazoline 1,000 ppm of each was added.
Note 3.

$$\text{Oil separation ratio (\%)} = \frac{\text{Volume of oil layer after centrifugal separation} \times 100}{\text{Amount of additive} + \text{Oil content in waste oil}}$$

EXAMPLE 40

A water-containing waste oil D (90.1% of oil (A<0.1), 5.4% of water and 4.5% of solid content) originated from a lublicant oil and containing petroleum oils as principal constituents and a water-containing waste oil E (82% of oil (B>0.8) (tar-based heavy oils having a boiling point higher than 200° C. constitute the principal components), 15% of water and 3% of solid content) were mixed to separate the oil components. (1) The mixture of the waste oils D and E was kept at 70° C. for 2 hours.

| Waste oil D (ml) | Waste oil E (ml) | Separated Oil layer (ml) |
|---|---|---|
| 0 | 20 | 0 |
| 1 | 19 | 14 |
| 10 | 10 | 15.5 |
| 19 | 1 | 16.5 |
| 20 | 0 | 0 |

(2) The mixture of the waste oils D and E was centrifuged at 1,250 G for 15 minutes and then kept to stand still for a short period of time for separation of oil components.

| Waste oil D (ml) | Waste oil E (ml) | Separated oil layer (ml) | Water layer (ml) | Sludge (ml) |
|---|---|---|---|---|
| 0 | 20 | 0 | 0 | 1.0 |
| 10 | 10 | 16.5 | 1.5 | 1.5 |
| 20 | 0 | 0 | 0 | 1.5 |

(3) The mixture of the waste oils D and E with added surfactant was centrifuged at 1,250 G for 15 minutes and subjected to the oil-water separation.

| Waste Oil D (ml) | Waste oil E (ml) | Surfactant (ppm) | Separated oil layer (ml) | Emulsion (ml) | Water layer (ml) | Sludge (ml) |
|---|---|---|---|---|---|---|
| 0 | 20 | Cationic 1,000 | 9.2 | 9.0 | 0.0 | 1.8 |
| 10 | 10 | Cationic 1,000 | 17.0 | 0 | 1.6 | 1.4 |

-continued

| Waste Oil D (ml) | Waste oil E (ml) | Surfactant (ppm) | Separated oil layer (ml) | Emulsion (ml) | Water layer (ml) | Sludge (ml) |
|---|---|---|---|---|---|---|
| 20 | 0 | Anion | 14.2 | 1.0 | 2.7 | 2.1 |

Note 1. Cationic: Imidazoline type cation surfactant
Note 2. Anionic: Alkyl sodium sulfosuccinate ester

INDUSTRIAL APPLICABILITY

As described hereinabove, the method of the present invention for the treatment of a water-containing waste oil is useful for treating tar-based water-containing waste oils discharged from coal tar plants or petroleum-based water-containing waste oils, originated from the rolling or tube making processes at ironworks or from the process of washing crude oil tanks or heavy oil tanks at petroleum refineries and petrochemical plants or derived from crude oil wastes, heavy oil wastes or residual oils in tanks.

What is claimed is:

1. A method for treating a water-containing waste oil comprising oils, water, and solid constituents in which the water is present in a water-in-oil emulsion, which comprises adding to the water-containing waste oil having an aromatic oil ratio A at least 1% by weight, on the basis of the weight of the water-containing waste oil, of a treating oil having an aromatic oil ratio B in which the values of the aromatic oil ratios, A and B, are determined by the following formula:

$$\text{Aromatic oil ratio} = \frac{\text{Weight of aromatic oil content}}{\text{Weight of total oil content}}$$

and in which, when A is greater than 0.5, B is less than 0.4 and, when A is less than 0.5, B is greater than 0.6, whereby in the water-containing waste oil and treating oil mixture the oil content is separated from the water and the solid constituents, and recovering the separated oil.

2. A method as claimed in claim 1, wherein the amount of the treating oil added to the water-containing waste oil is 2 to 100% by weight.

3. A method as claimed in claim 2, wherein the amount of the treating oil added to the water-containing waste oil is 5 to 50% by weight.

4. A method as claimed in claim 1, wherein the aromatic oil ratio A of the water-containing waste oil minus the aromatic oil ratio B of the treating oil is greater than 0.7.

5. A method as claimed in claim 1, wherein the addition of the treating oil is followed by removal of the solid content by means of a centrifugal force and then by separation of oil and water by means of a standing still separation.

6. A method as claimed in claim 5, wherein the centrifugal force is at least 800 G.

7. A method as claimed in claim 1, wherein the addition and mixing of the treating oil are conducted at a temperature of 20° to 90° C.

8. A method as claimed in claim 7, wherein the addition and mixing of the treating oil are conducted at a temperature of 50° to 70° C.

9. A method as claimed in claim 1, wherein the aromatic oil ratio of the water-containing waste oil is $A<0.4$ or $A>0.6$.

10. A method as claimed in claim 9, wherein the water-containing waste oil has an aromatic oil ratio of $A>0.6$ and is a water containing waste oil derived from coal tar.

11. A method as claimed in claim 10, wherein the treating oil has an aromatic oil ratio of $B<0.4$ and is an aliphatic oil derived from petroleum.

12. A method as claimed in claim 11, wherein the aliphatic oil is selected from a group consisting of kerosene, light oil and fuel oil-A.

13. A method as claimed in claim 10, wherein along with treating oil, a cationic surfactant containing a quaternary ammonium salt or imidazole derivative as the principal component is added in an amount of 100 to 3,000 ppm to the water-containing waste oil.

14. A method as claimed in claim 9, wherein the water-containing waste oil has an aromatic oil ratio of $A<0.4$ and is a water-containing waste oil derived from petroleum.

15. A method as claimed in claim 14, wherein the treating oil has an aromatic oil rato of $B>0.6$ and is an aromatic oil derived from coal tar.

16. A method as claimed in claim 15, wherein the aromatic oil contains distillates having a boiling point of 130° to 275° C., as principal constituents.

17. A method as claimed in claim 16, wherein the aromatic oil contains 20 to 60% by weight of naphthalene.

18. A method as claimed in claim 16, wherein the aromatic oil is a residual oil obtained by distillation of a light oil to remove distillates up to xylene, said light oil being obtained either by distillation of coal tar or by collection from a coke oven gas.

19. A method as claimed in claim 14, wherein along with the treating oil, an anionic or nonionic surfactant is added in an amount of 100 to 5,000 ppm to the water-containing waste oil.

20. A method as claimed in claim 1, wherein pH of the mixture is 4 to 8.

21. A method as claimed in claim 20, wherein pH of the mixture is 6 to 7.

* * * * *

UNITED STATES PATENT AND TRADEMARK OFFICE

CERTIFICATE OF CORRECTION

PATENT NO. : 4,336,129

DATED : June 22, 1982

INVENTOR(S) : Tokuo Yoshimura, Hiroshi Okazaki, Mahito Soeda and Takeharu Yushima It is certified that error appears in the above-identified patent and that said Letters Patent is hereby corrected as shown below:

Title Page, [75] INVENTORS, line 2; "Fukuoka" should read -- Munakata --
Declaration, 202.
Col. 4, line 43, first word of the line; "in" should read -- In --
Col. 4, line 45; "aromatic" should read -- atomic --
Col. 4, line 62; "polyalkybenzene" should read -- polyalkylbenzene --
Col. 5, line 29; "accouts" should read -- accounts --
Col. 7, line 23; "$R_{8'}OOCCH_3$" should read -- $R'_8OOCCH_3$ --

Col. 7, line 30; "$R_{10'}$" should read -- $R_{10}$ -- (delete the " ' ")
Col. 7, line 34; "$R_{10'}$" should read -- $R'_{10}$ --

Col. 7, line 44; "$R_{12'}$" should read -- $R_{12}$ -- (delete the " ' ")
Col. 8, line 37; "$H(C_2H_4O)_{y'}(C_3H_6O)_x$" should read -- $H(C_2H_4O)_y(C_3H_6O)_x$ --
(delete the " ' " after "y")
Col. 9, last two lines in column; "Comparative" should be in Column 10, just preceding "Examples" (approximately line 7).
Col. 10, line 21; "rate" should read -- factor --

Col. 10, line 51; "3,000 g" should read -- 3,000 G --

UNITED STATES PATENT AND TRADEMARK OFFICE

CERTIFICATE OF CORRECTION

PATENT NO. : 4,336,129

DATED : June 22, 1982

INVENTOR(S) : Yoshimura et al.

It is certified that error appears in the above-identified patent and that said Letters Patent is hereby corrected as shown below:

Col. 11, line 25; "Ratio" should read -- Factor --

Col. 12, line 7; "Fuel" should read -- fuel --
Col. 12, line 57; "(A—0.2)" should read -- (A<0.2) --

Col. 13, line 64; "9" should be on the line preceding it (line 63) and should not be split from the word "EXAMPLE"
Col. 15, Table 6, second column, first line; "Amionic" should read*-- Anionic --

Col. 18, line 30; "Anion" should read -- Anionic --

Col. 18, line 31, Note 1; "cation" should read -- cationic --

Col. 20, line 14; "rato" should read -- ratio --

Signed and Sealed this

*Twenty-third* Day of *November 1982*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,336,129

DATED : June 22, 1982

INVENTOR(S) : Tokuo Yoshimura et al.

It is certified that error appears in the above—identified patent and that said Letters Patent is hereby corrected as shown below:

Column 17, Table 7 continued, Note 1, line 2, "factor" should read -- ratio --.

Column 17, Table 7 continued, Note 3, "ratio" should read -- factor --.

Signed and Sealed this

*Eighth* Day of *February 1983*

[SEAL]

*Attest:*

GERALD J. MOSSINGHOFF

*Attesting Officer*

*Commissioner of Patents and Trademarks*